United States Patent [19]

Schuder et al.

[11] 4,327,259

[45] Apr. 27, 1982

[54] TIMING MECHANISM

[75] Inventors: Maurice E. Schuder, Indianapolis; Richard W. Stafford, Clayton, both of Ind.

[73] Assignee: Emhart Industries, Inc., Indianapolis, Ind.

[21] Appl. No.: 148,714

[22] Filed: May 12, 1980

[51] Int. Cl.[3] ..... H01H 43/10

[52] U.S. Cl. ..... 200/38 A; 200/38 FA; 200/38 CA; 200/293; 340/309.1

[58] Field of Search ..... 200/38 R, 38 A, 38 F, 200/38 FA, 38 FB, 38 B, 38 BA, 38 C, 38 CA, 38 D, 38 DA, 38 DB, 38 DC, 38 E, 293; 340/309, 309.1, 309.2, 309.3, 309.4, 309.5, 309.6

[56] References Cited

U.S. PATENT DOCUMENTS 3,862,385 1/1975 Johnson ..... 200/38 R 3,866,003 2/1975 Fox ..... 200/38 FA

*Primary Examiner*—J. V. Truhe

*Assistant Examiner*—Morris Ginsburg

*Attorney, Agent, or Firm*—Robert F. Meyer; David W. Gomes

[57] ABSTRACT

There is disclosed a timing mechanism utilizing a digital interval timer composed of rotating drum wheels each having a cam to close electrical switches to provide a program sequence. Cam followers are constructed and arranged so that when they drop in notches of the cams the drum wheels can be rotated in either direction.

An auxiliary program is provided by a slideable drum shaped helical cam that actuates a cam follower. The drum shaped helical cam is manually axially set to provide a desired program. Both the drum shaped helical cam and the drum wheels are power driven from the same source.

The timing mechanism is packaged in a cup shaped housing having individual ribs in its side-walls to receive a frame carrying the drum wheels and the drum shaped helical cam.

15 Claims, 5 Drawing Figures

TIMING MECHANISM

BACKGROUND OF THE INVENTION

Generally speaking, the present invention pertains to improvements in a timing mechanism wherein coupled drum wheels of a digital interval timer are rotatably set at a predetermined period of time; wherein at least one cam having a notch opening to an outer periphery of the cam is rotatably coupled to at least one of the drum wheels; and wherein an actuator means engages the cam to open and close electrical switches, the switches being opened when the actuator means drops into the notch; one improvement characterized by the cam and the actuator means being operably associated with each other so that the drum wheels may be rotated in either direction after the electrical switch has been opened.

Another improvement relates to a means providing an auxiliary program for the mechanism which, in general, comprises a drum shaped helical cam, means applying power driven rotation to the drum shaped helical cam, a cam follower engaging the drum shaped helical cam, at least one electrical switch opened and closed by the cam follower, and actuator means causing relative movement between the helical cam and the cam follower.

Another improvement relates to a case for the timing mechanism which, in general, comprises a cup shaped member having a base portion, a pair of side walls, a pair of end walls, and an open end, a base plate closing the open end and having an opening through which the drum wheels protrude, individual ribs in the side walls each having slots therein, individual plates carried in the slots and means carried by the plates receiving the drum wheels and the drum shaped helical cam, and apertures in the base portion receiving electrical terminals carried by the base portion, and at least one output member from a gear train of a motor drive means carried by the base portion.

The present invention relates to a timing mechanism and more particularly to a timing mechanism using a digital interval timer. Timing mechanisms utilizing digital interval timers have been used for many years in appliances such as ovens and ranges and in recent years in appliances such as microwave ovens.

In most, if not all of such applications, drum wheels having coded indicia to indicate time are rotatably coupled together through commonly used geneva gear drives. Also cams are usually coupled to the drum wheels for rotation with the wheels to open and close electrical switches. Such cams usually employ a notch to actuate a cam follower with the cam follower falling into the notch. One of the problems with such an arrangement is that of being unable to rotate the drum wheels in either direction when the cam follower is in the notch. This then causes the operator, in many instances, to rotate the drum wheels many turns when a new time needs to be set.

In microwave oven applications, it has been found to be, at times, necessary to provide an auxiliary program in addition to the normal program usually required for cooking times. More specifically, it has been found to be highly desirable, if not necessary, to vary the power to the magnetron of the microwaven oven during certain cooking time periods.

The type of timing mechanisms discussed herein also have a "packaging problem" in that they are inherently complicated and therefore somewhat difficult to assemble.

The present invention is directed to features of digital interval timing mechanisms which solve these problems.

FEATURES OR OBJECTS OF THE INVENTION

Accordingly, it is a feature of the invention to provide a timing mechanism wherein drum wheels provide a digital interval timer and wherein cams are coupled to the drum wheels to actuate cam followers to open and close electrical switches. Another feature of the invention is to provide for such a timing mechanism wherein the drum wheels may be rotated in either direction even when the cam follower drops in the notch. Another feature of the invention is the provision of such a timing mechanism wherein the notch and the cam follower are constructed and arranged so that the resultant force vector between the notch of the rotating cam and the cam follower when they are engaged is in a direction away from the notch regardless of the direction of the cam's rotation.

Still another feature of the invention is the provision of such a timing mechanism where there is a means to provide an auxiliary program other than the normal program of the timing mechanism. Yet another feature of the invention is the provision of such a timing mechanism wherein such means includes a drum shaped helical cam, a cam follower, means to provide relative axial movement between the drum shaped helical cam and the cam follower. Another feature of the invention is the provision of such a timing mechanism wherein power driven rotation of the drum shaped helical cam is provided by the same means that provide power driven rotation to the drum wheels.

Another feature of the invention is the provision of such a timing mechanism wherein the elements of the mechanism are packaged within a housing such that the mechanism is relatively easy to assemble. Another feature of the invention is the provision of such a timing mechanism wherein the housing includes a cup shaped member with an open end with ribs in its side walls to receive a frame carrying the drum wheels and the drum shaped helical cam. Yet another feature of the invention is the provision of such a timing mechanism wherein apertures are provided in the cup shaped member to receive electrical terminals carried by the cup shaped member and at least one output member of a motor drive carried by the cup shaped member.

These and other features of the invention will be apparent from the following description taken in conjunction with the accompanying drawings.

DETAILED DESCRIPTION OF THE DRAWINGS

DESCRIPTION OF THE INVENTION

Figure 1:
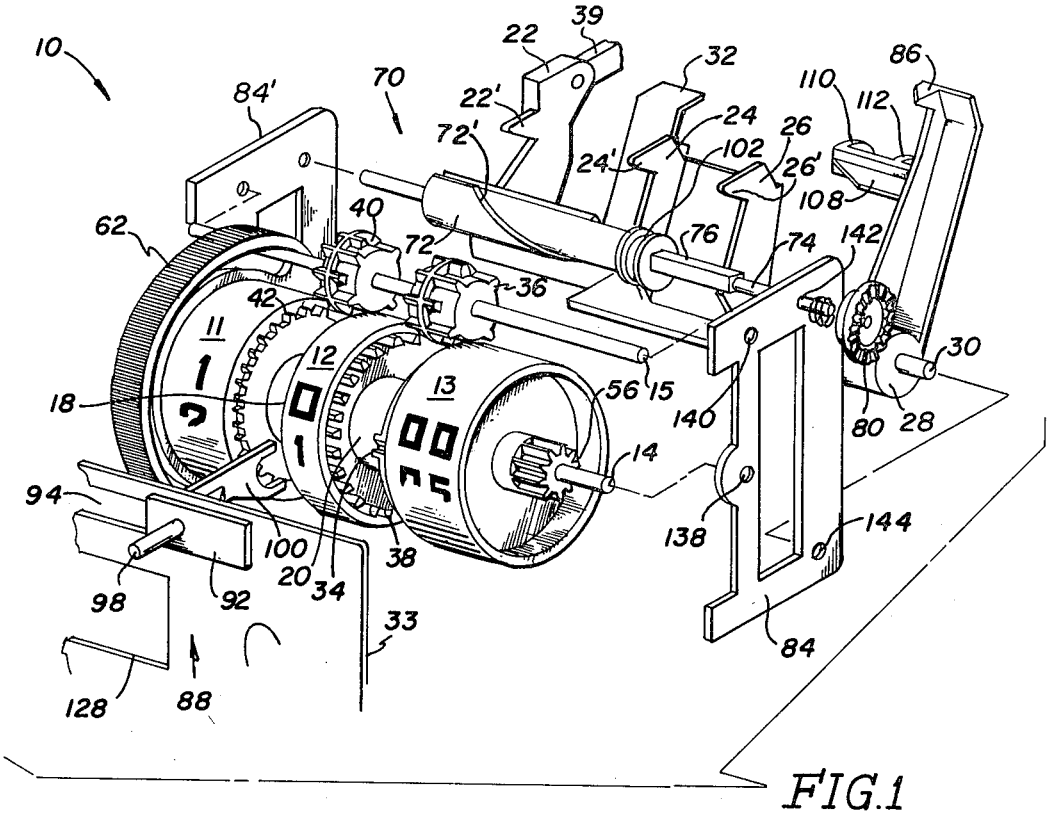
FIG. 1 is an exploded view of a timing mechanism employing the features of the invention.

Referring now to the drawings, there is shown a timing mechanism 10 employing the features of the invention. In general, the timing mechanism includes a plurality of drum wheels 11, 12 and 13 rotatably carried on a shaft 14, a plurality of cams 16, 18 and 20 carried on shaft 14 and coupled to the individual drum wheels, cam followers 22, 24 and 26 which are actuated by the cams to open and close electrical switches in a manner well known in the art. Each of the drum wheels has coded indicia on their outer periphery to indicate time periods. In the present embodiment, drum wheel 11 indicates tens of minutes, drum wheel 12 indicates minutes and drum wheel 13 indicates seconds. The drum wheels are coupled together such that drum wheel 13 drives drum wheel 12 and drum wheel 12 drives drum wheel 11 through individual geneva drives 34, 38, 39 and 42 carried on shaft 14, and 36 and 40 carried on shaft 15. The operation of geneva drives are well known in the art and since the drum wheels and their geneva drives do not form part of the invention, a detailed description and drawings have been omitted for the sake of simplicity.

Figure 2:
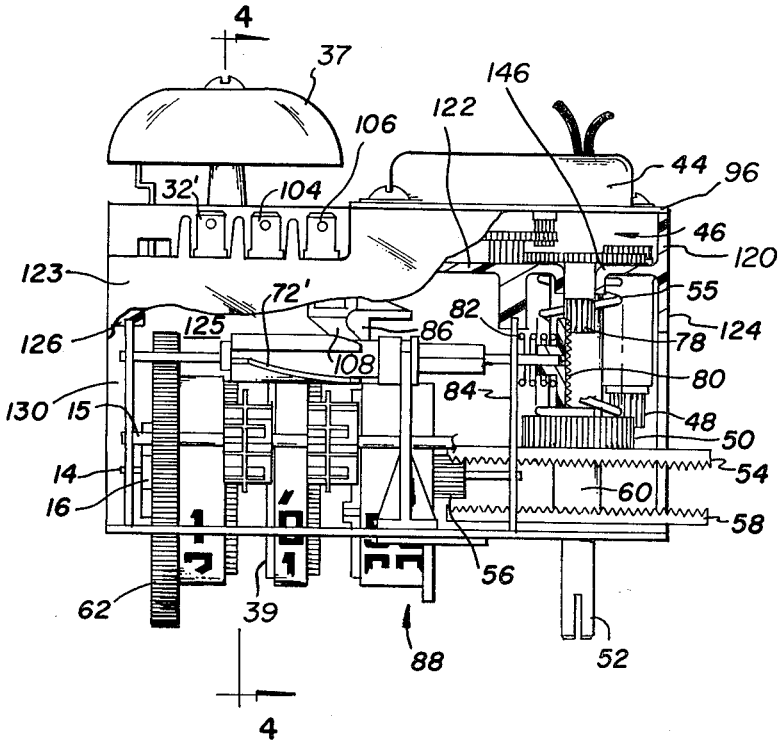
FIG. 2 is a top view of the mechanism in partial cross-section.

As better shown in FIG. 2, power driven rotation is applied to the drum wheels from motor 44, through gear train 46 to an output pinion 48 to a gear 50 which is rotatably carried on shaft 52 and fixedly connected to face gear 54 which in turn engages gear 56 which is intergral with drum wheel 13. A desired cooking cycle may be set by axially indexing shaft 52 "in" to move face gear 54 out of engagement with gear 56 against spring 55 and move face gear 58 into engagement with gear 56 and rotating the shaft. After setting the drum wheels, shaft 52 is released and face gear 54 again engages 56 through the expansion of spring 55. Spacer 60 separates face gears 54 and 58. A thumb wheel 62 provided on drum wheel 11 reduces the number of setting rotations of shaft 52. Rotation of thumb wheel 62 is accomplished through a clutch (not shown) in a manner well known in the art.

Figure 3:
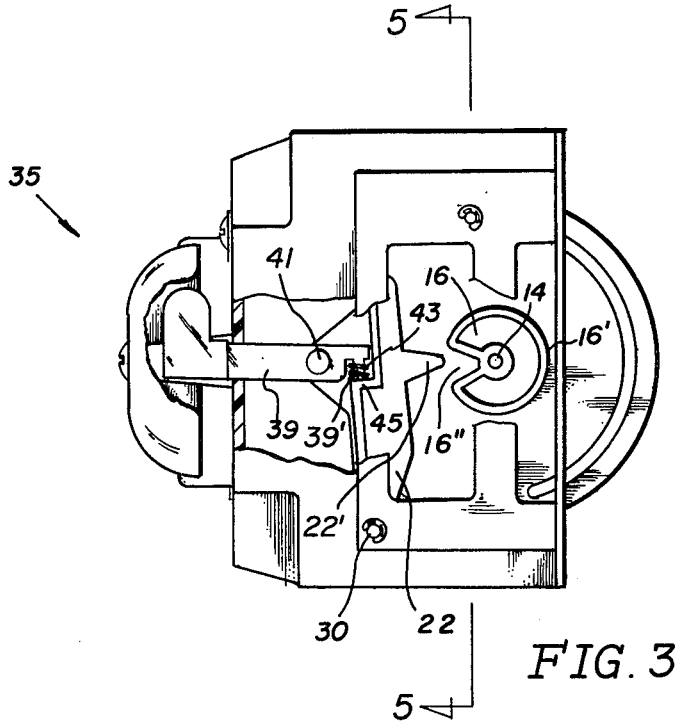
FIG. 3 is an end view of the timing mechanism in partial cross-section.
Figure 5:
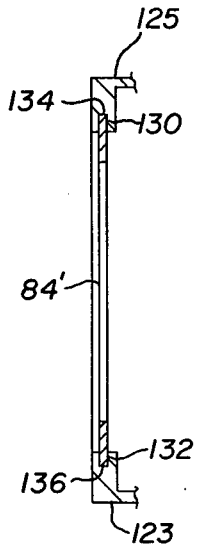
FIG. 5 is a view taken along the line 5—5 of FIG. 3.
Figure 4:
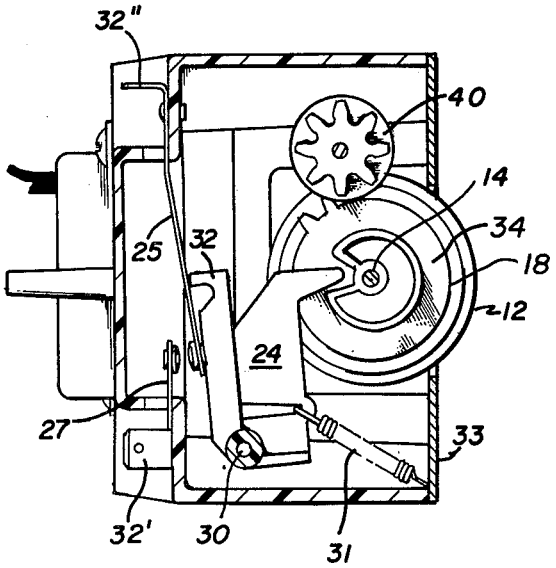
FIG. 4 is a view taken along the line 4—4 of FIG. 2.

Cams 16, 18 and 20 are substantially the same and therefore the description with regard to cam 16 of FIG. 3 and cam 18 of FIG. 4 applies to cam 20. Each of the cams are carried on an individual drum wheel, cam 16 on drum wheel 11, cam 18 on drum wheel 12 and cam 20 on drum wheel 13. As shown, each of the cams includes an outer periphery 16' and a notch 16'' opening to the outer periphery. Cam followers 22, 24 and 26 (FIG. 1) engage cams 16, 18 and 20, respectively through V-shaped followers 22', 24' and 26'. The cam followers are carried on a sleeve 28 which is rotatably carried on a shaft 30. Since the followers act as a unit in that a switch is only to be opened or closed when a certain time period is met, all three followers will be in the same mode at a given time. At any particular time, switch actuator 32 of follower 24 actuates blades 25 and 27 (FIG. 4) to open or close an electrical circuit to terminals 32' (FIG. 2) and 32'' (FIG. 4) to provide a program sequence. As shown in FIG. 4, cam follower 24 is spring biased toward cam 18 by spring 31 which is attached to the follower and to plate 33 to provide a fast drop of the cam follower into notch 16''. Since cam followers 22, 24 and 26 are all carried on sleeve 28, cam followers 24 and 26 are also provided with a fast drop from the action of the spring 31.

As better shown in FIG. 3, an alarm means 35 is associated with cam follower 22 to provide an alarm when the follower drops into notch 16''. Alarm means 35 includes a bell 37 and hammer 39 which is pivotaly mounted on cam follower 22 at pivot 41. When the cam follower drops into notch 16'', the side 45 of the follower forces the hammer to pivot and strike the bell. Spring 43, which is carried on tab 39', acts as a shock absorber, there being a little "play" between hammer 39 and follower 22.

According to a feature of the invention, the cam followers and the notches 16'' of the cams are in operable relation to each other so that drum wheels 11, 12 and 13 may be rotated in either direction even though the cam followers have dropped into the notches. More specifically, notches 16'' and the cam followers are V-shaped and the pivot point of the cam followers, that is shaft 30, are in plane opposite the opening of the notches when the cam followers are engaged in the notches. This results in a resultant force vector between the notch of the rotating cam and the cam follower when they are engaged that is in a direction away from the notch regardless of the direction of cam rotation.

With reference to FIGS. 1 and 2, according to another feature of the invention, an auxiliary program is provided by another program means 70. Program means 70 includes a drum shaped helical cam 72 that is axially slideable on shaft 74, the cam being rotatable with the shaft through the shaft's flat portion 76. Power driven rotation is applied to shaft 74 from motor 44 through gear train 46 to another output pinion 78 of the gear train which engages face gear 80, face gear 80 being fixedly carried on the shaft. There is a small amount of axial "play" in shaft 74 so that engagement between the face gear and pinion 78 can be insured through spring 82 that is biased between the face gear and plate 84. Thus drum wheels 11, 12 and 13 with their respective cams 16, 18 and 20 and helical cam 72 are rotatably driven off the same power source. Helical cam 72 includes a helical cam lobe 72' which engages cam follower 86 which is pivotaly mounted on shaft 30. The helical cam may be manually axially moved on shaft 74 to provide a desired setting of cam lobe 72' with respect to cam follower 86. Such manual setting is accomplished by actuator means 88. Actuator means 88 includes a slider composed of a block 92 slideably carried in a slot 94 of a front plate 33, a handle 98 to manually move the block, and a yoke 100 extending from the block and engaging a groove 102 provided in helical cam 72. Manually axially moving the slider sets the position of the helical cam with respect to cam follower 86. Rotation of cam 72 causes cam follower 86 to open and close electrical circuits to switches 104 and 106 (FIG. 2) through a switch actuator block 108 (FIG. 1) attached to the cam follower and having two lobes 110 and 112 for engaging contact blades (not shown). Thus an auxiliary program is provided for the timing mechanism.

Another feature of the invention pertains to the manner in which the timing mechanism is packaged. As will be apparent, the mechanism is packaged so that the unit as a whole is very easy to assemble. Referring in particular to FIGS. 1 and 2, the timing mechanism is enclosed in a housing which includes a cup shaped plastic member 120 having a base portion 122, a pair of end sidewalls 124 and 126, a pair of side walls 123 and 125, and a plate 96 closing the open end of the cup shaped member. Plate 33 has an opening 128 through which drum wheels 11, 12 and 13 protrude. Two pairs of opposed ribs, 130 and 132, are provided in the opposed side walls 123 and 125 (half of each pair shown). In each rib there are slots 134 and 136 provided in the ribs (half of each pair shown) for receiving plates 84 and 84'. As better shown in FIG. 1, plates 84 and 84' provide frames for receiving shafts 14, 15 and 74 with their associated mechanism. Plate 84 is located between the end walls while plate 84' is formed as part of an end wall. To assemble the timing mechanism, the various elements are first assembled on their respective shafts and the shafts are inserted in apertures 138, 140, 142, 144 of plate 84 then the shafts are inserted in corresponding apertures of plate 84' to form a single modular unit. The plates are then inserted in the slots and then plate 96 is positioned to close the open end of the cup shaped member.

Base portion 122 of cup shaped member 120 carries gear train 46 as well as electrical terminals 32', 104 and 106 and bell 35 outside the cup portion, there being apertures 146 in the base portion to receive at least one output member of the gear train.

What is claimed is:

1. In a timing mechanism wherein coupled drum wheels of a digital interval timer are rotatably set at a predetermined period of time; wherein at least one cam having a notch opening to an outer periphery of said cam is rotatably coupled to at least one of said drum wheels; and wherein an actuator means engages said cam to open and close an electrical switch, said switch opening when said actuator means drops into said notch, an improvement characterized by said actuator means including a pivoting member pivotally mounted with respect to said notch, said pivotally mounted member and said notch provide means such that a resultant force vector between said notch and said pivoting member when they are engaged is in a direction away from said notch, and means whereby said drum wheels may be rotated in either direction after said electrical switch has been opened.

2. In a timing mechanism according to claim 1 wherein said pivoting member is pivotally mounted in a plane opposite an opening of said notch when said actuator means is engaged in said notch.

3. In a timing mechanism according to claim 1 wherein said pivoting member includes a lever that is spring biased toward said notch to provide a fast drop of said lever into said notch.

4. In a timing mechanism according to claim 3 further including alarm means associated with said timing mechanism and striking means operably associated with said lever engaging said alarm means in response to a drop of said lever.

5. In a timing mechanism according to claim 4 wherein said striking means includes a hammer pivotally mounted on said lever and spring biased against same.

6. A timing mechanism comprising a drum shaped helical cam, means applying power driven rotation to said drum shaped helical cam, a cam follower engaging said drum shaped helical cam, at least one electrical switch opened and closed by said cam follower, and manual actuator means cooperating with means on said helical cam causing relative axial movement between said helical cam and said cam follower.

7. A timing mechanism according to claim 6 wherein said drum shaped helical cam is slideably carried on a shaft and said actuator means causes said drum helical cam to move axially along said shaft.

8. A timing mechanism according to claim 7 wherein said actuator means includes a slider carried in a frame for said timing mechanism and engaging said drum shaped helical cam.

9. A timing mechanism according to claim 8 wherein said drum shaped helical cam includes a groove receiving said slider.

10. In a timing mechanism wherein coupled drum wheels of a digital interval timer are manually rotatably set at a predetermined period of time; wherein a first drive means provides power driven rotation to said drum wheels; and wherein cam means providing a program sequence are coupled to said drum wheels to be rotated therewith and open and close first electrical switches operably associated with said cam means; means opening and closing second electrical switches to provide an auxillary program comprising:

(a) a drum shaped helical cam,
(b) second drive means applying power driven rotation to said drum shaped helical cam,
(c) a cam follower engaging said drum shaped helical cam, and
(d) actuator means cooperating with means on said helical cam causing relative movement between said helical cam and said cam follower.

11. In a timing mechanism according to claim 10 wherein said first and second drive means are connected together.

12. In a timing mechanism according to claim 10 wherein the connected drive means includes a motor and a gear train coupled thereto, said gear train having two output members.

13. A combination of a housing with a timing mechanism and a motor drive means including a gear train which includes a rotating member carried by a shaft comprising:

(a) a cup shaped member having a base portion, a pair of side walls, a pair of end walls, and an open end,
(b) a plate closing said open end and having an opening through which said rotating member protrudes,
(c) first and second pairs of opposed individual ribs in said side walls each having slots therein,
(d) individual plates carried in said slots and means carried by said plates receiving said shaft, and
(e) apertures in said base portion receiving electrical terminals carried by said base portion and at least one output member from said gear train carried by said base portion.

14. The combination according to claim 13 wherein at least one of said pair of ribs is provided between said pair of end walls.

15. The combination according to claim 13 wherein one of said pair of ribs is provided between said pair of end walls and the other pair of ribs is provided by a cut away portion in one wall of said pair of end walls.

* * * * *